United States Patent [19]

Erickson

[11] Patent Number: 4,632,586

[45] Date of Patent: Dec. 30, 1986

[54] FILE FOLDER DOCUMENT HANDLING SYSTEM

[76] Inventor: Glenn A. Erickson, 25101 Rivendell, El Toro, Calif. 92630

[21] Appl. No.: 741,151

[22] Filed: Jun. 4, 1985

[51] Int. Cl.[4] ..... B42F 13/00

[52] U.S. Cl. ..... 402/7; 402/80 R

[58] Field of Search ..... 402/7, 24, 25, 15, 18, 402/80 R

[56] References Cited

U.S. PATENT DOCUMENTS

| | | | |
|---|---|---|---|
| 4,084,911 | 4/1978 | DeWitt | 402/15 |
| 4,427,315 | 1/1984 | Raisch | 402/7 X |

FOREIGN PATENT DOCUMENTS

| | | | |
|---|---|---|---|
| 543464 | 2/1932 | Fed. Rep. of Germany | 402/7 |
| 7507596 | 12/1976 | Netherlands | 402/7 |
| 1001994 | 8/1965 | United Kingdom | 402/7 |
| 2035215 | 6/1980 | United Kingdom | 402/7 |

*Primary Examiner*—Paul A. Bell

*Attorney, Agent, or Firm*—Herb Boswell

[57] ABSTRACT

A document file folder of the type having a flat metallic fastening member is improved by crimping the ends of its metallic fastening member so as to bring the parallel sides of the ends of the flat metallic member toward one another to form a protrusion on each of the ends of the flat metallic member. An element is formed so as to be essentially U-shaped and have hollow ends. The hollow ends of the element are sized and shaped so as to receive the crimped ends of the metallic fastening member so as to facilitate removal of overlying documents from said document file folder, insertion of a document onto said fastening members and replacement of the removed documents back onto the metallic fastening member.

7 Claims, 10 Drawing Figures

FILE FOLDER DOCUMENT HANDLING SYSTEM

BACKGROUND OF THE INVENTION

This invention is directed to an improvement in a document file folder and a process of forming the same. The improvement includes forming crimped ends on the metallic fastening member utilized in the document file folder for holding documents in the file folder.

Businesses rely extensively on document file folders for retaining documents in a neat and orderly manner. Document file folders have been produced which include metal fasteners which have their central section connected to the support material of the file folder and are flexible such that their arms or tabs can be bent upward in a parallel relationship so as to accept documents which are hole-punched with the tabs then being bent downwardly towards the file folder to retain the documents thereon.

It is very easy to add documents to the top of the stack of documents retained in the file folder of the type described in the previous paragraph. One simply bends the arms of the metal fastener upward, slides the new documents onto the top of the existing stack, and then folds the metal fasteners downward.

It is much more difficult, however, to insert a document in the middle of the stack of documents, or to remove a document from the middle of the stack of documents. To do this, all the overlying documents must be removed from the metal fasteners. When the stack of documents are removed from the metal fasteners, it is very easy to mis-align the documents such that the paper holes are no longer in alignment. This makes re-insertion of the documents back onto the metal fasteners very difficult. This is especially true with file folders which are utilized to hold a variety of sizes of documents. The small documents are very easily misaligned, and as such, sometimes when inserting the stack of documents back onto the metal fasteners, these documents, in fact, do not get connected to the metal fasteners and can be dropped from the file when the file is moved.

One system to circumvent the problems with regard to addition and removal of documents to and from a file folder is described in U.S. Pat. No. 4,084,911. The fasteners described in that patent are hollow plastic tubes which are flatter in the middle and heat welded to the file and are utilized in conjunction with a stiff keeper through which the tubes are intertwined for retaining documents on the file. A U-shaped bar having male ends is utilized in conjunction with the two other components. The male ends are slipped into the female ends of the fastener tubes for removal and insertion of documents within the stack of documents in the file.

In many situations such as hospitals, courts, and the like where files must be retained for long periods of time, there can be hundreds of thousands of individual files which must be retained. It is expensive to provide this document storage space. The use of a keeper, as is described in U.S. Pat. No. 4,084,911 in the preceding paragraph, results in excess space taken up by each and every file simply to retain the documents therein, without even considering removal or insertion of documents within each individual file. The keepers of U.S. Pat. No. 4,084,911 themselves are approximately 3/32 inch thick, however, when the tubular file fasteners are wound through these keepers, even without a single paper being held in the file, the keeper is elevated to at least 3/8 inch. In a single file this may not be critical, but when thousands of files, and even hundreds of thousands of files must be stored for long periods of time, the space taken up by the individual fasteners of the type described in U.S. Pat. No. 4,084,911, when multipled together, can result in tens, hundreds, or even thousands of feet of expensive file space.

BRIEF DESCRIPTION OF THE INVENTION

In view of the above, it is an object of this invention to provide an improvement in document file folders which allow for easy insertion and removal of documents within the stacks of documents in individual files, yet provide a space saving system which does not add undo thickness to the files. It is a further object of this invention to provide an improved document file folder which can be easily integrated with document file folders now in existence. It is a further object to provide a document file system which, because of the manufacturing and engineering principles embodied therein, is extremely economical and does not add excessive cost to the document file folders.

These and other objects are achieved in an improvement in a document file folder which comprises: a flat elongated member, said member having first and second ends and side edges, said member formed of a metallic material which is capable of repeatedly being deformed from an existing configuration to a new configuration and retaining said new configuration; attaching means associated with said elongated member, said attaching means for fixedly attaching said file folder a central portion of said elongated member wherein said central portion of said member is located intermediate the ends of said member; each of said ends of said member crimped so as to bring the side edges of said flat member toward one another in a spaced parallel relationship and to form a protrusion on each of the ends of said member which extends beyond the plane of said flat member on one of the flat sides of said member, said protrusions being essentially U-shaped in cross section and having an elongated central channel, said elongated central channel having an axis which extends along the elongated dimension of said channel with said axis of said channel lying along the elongated dimension of said member; an element, said element having a first arm, a second arm and a connecting section which joins said first and said second arms, said first and said second element arms extending in a parallel space relationship from said connecting section in the same direction from said connecting section; each of said first and said second arms of said element having a hollow open end, each of said hollow open ends of said element arms being sized and shaped to accept and temporarily retain one of said ends of said member.

Further, these objects are achieved in a process of improving a document file folder of the type incorporating a metallic fastener which comprises: locating said metallic fastener in a die, said die having a first elongated groove and a second elongated groove, said first elongated groove of a width so as to receive said metallic fastener, said second elongated groove of a width narrower than said first elongated groove and positioned centrally within said first elongated groove; locating a second die over said metallic fastener, said elongated second die having a die element formed as an elongated narrow blade of a width narrower than said second groove of said first die; depressing said second die into said metalic fastener to depress a portion of the end of said metallic fastener into said second groove of said first die so as to form said end of said metallic fastener around said narrow blade on said second die; forming an element having a first arm, a second arm, and a connecting element such that said first and said second arms are located in a parallel space relationship from one another and extend from said connecting section; forming said element to include a hollow area in the ends of each of said first and said second arms wherein said hollow area is sized and shaped so as to accept and temporarily retain each of said crimped ends of said retaining member.

BRIEF DESCRIPTION OF THE DRAWINGS

This invention will be better understood when taken in conjunction with the drawings wherein.

This invention utilizes certain principles and/or concepts as are set forth in the claims appended hereto. Those skilled in the manufacturing arts will realize that these principles and/or concepts are capable of being utilized with a variety of embodiments which may differ from the exact embodiment utilized for illustrative purposes herein. For this reason this invention is not to be construed as being limited solely to the illustrative embodiment, but should only be construed in view of the claims.

DETAILED DESCRIPTION OF THE INVENTION

Figure 1:
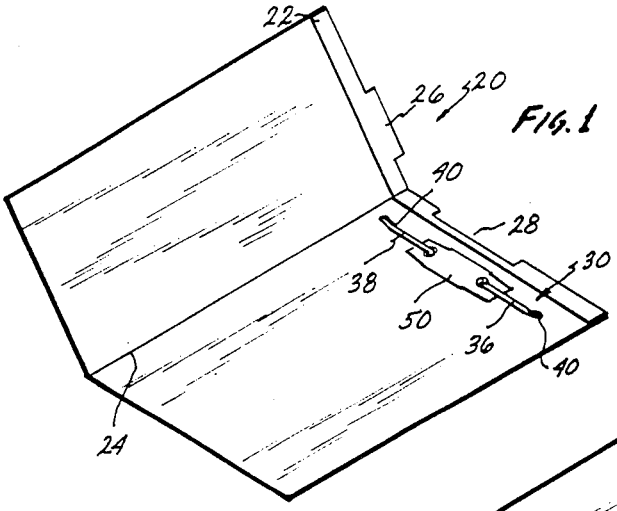
FIG. 1 is an isometric view of a file folder having fasteners made according this invention.

FIG. 1 shows a file folder 20 which is adapted to receive a collection of documents for safe storage therein. The file folder 20 is generally formed of a heavy paper stock which is reinforced with double thicknesses along edge 22 and includes a crease 24 for ease in folding. On the top of the folder 20 is a tab 26 for labeling purposes and on the opposite side a cut out 28 allowing viewing of the tab from both sides of the file. To complete the file 20 there is a fastener 30.

The file 20 shown in FIG. 1 is a typical type file which might be used in business. Other files which also embody the principles of the invention would be similar to the file 20, however, the fastener 30 could be placed in different parts of the file 20, as for instance parallel to the crease 24.

The fastener 30 shown in the file 20 has been modified to embody the principle of this invention and is not as would be seen in many common files which are available in typical stationary stores or the like. The modifications to the fasteners 30 is as best seen in other figures, however, prior to describing them in detail, reference is made to FIG. 2 showing utilization of this invention in association with a document 32 shown in phantom lines in FIG. 2.

Figure 2:
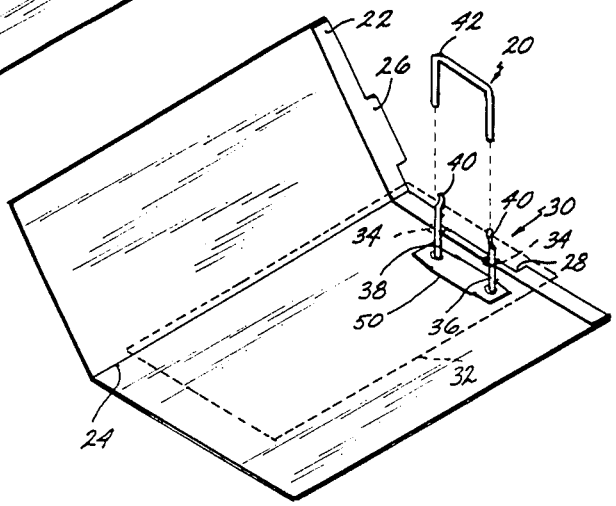
FIG. 2 is the file folder of FIG. 1 with the fasteners bent and shown in conjunction with a further element of the invention.

The document 32 has been punched to include two holes, collectively identified by the numeral 34, which allow it to slip over the fastener 30 when the fastener 30 has its respective arm 36 and 38 bent upwardly as seen in FIG. 2. This construction is the same as that seen in commercially available file folders. However, the fastener 30 as modified by this invention includes protrusions, collectively identified by the numeral 40, located on the ends of the respective arms 36 and 38. These protrusions, as will be described in greater detail below, allow for the location of a U-shaped assisting element 42 to be utilized in conjunction with the fastener 30 for removal of one or more of the documents 32 from the fastener 30.

To remove documents from the file folder 20 while maintaining these documents in correct order, first the arms 36 and 38 of the fastener 30 are bent upward as seen in FIG. 2. The assisting element 42 is then slipped over the protrusions 40 on the arms 36 and 38. All documents above the place wherein a new document will be inserted, or a document will be removed, are lifted up along the arms 36 and 38 onto the assisting element 42. The assisting elements 42 with the documents located thereon are then removed from the protrusions 40 on the arms 36 and 38 and the new document slipped onto the arms 36 and 38 of the fastener 30, or a document removed. When the desired operation is completed, the assisting element 42 with its load of documents located thereon, is then once again slipped over the ends of the protrusions 40 on the arms 36 and 38, and the documents on the assisting element 42 are slid down off of the assisting element back onto the arms 36 and 38 in proper order and without mis-alignment of their holes on the fastener 30. The assisting element 42 is then removed off of the protrusions 40 simply by lifting it up off of the protrusions 40, and the arms 36 and 38 are bent downward to the position seen in FIG. 1, once again holding in tact all the documents within the file folder 20.

Referring now to FIGS. 3–6, details of the fastener 30 of the invention are shown. The fastener 30 includes a flat elongated member 44 which is formed of a material, such as a metallic material, so that it can be repeatedly deformed by flexing and bending between the two positions seen in FIGS. 1 and 2 for addition or subtraction of documents from the file folder 20, and fastening of the same securely in the file folder 20. Depending upon the thickness of the stack of the documents, the member 44 will flex in different places along the length of the arms 36 and 38.

The member 44 is a continuous member with a central section 46 passing through holes, collectively identified by the numeral 48, in a connecting element 50. The element 50 is a thick fibrous material having an adhesive 52, or other joining means, on its bottom surface allowing for it to be firmly attached to the file folder 20 to adhere to the fastener 30 thereto.

Alternately, to the connecting element 50, the member 44 can be formed to be widened at the central section 46 and include extra tabs of material which are passed through slots in the file folder 20 to retain the same. This method of attachment is as is standard in the file manufacturing industry, and as such is not described in detail herein.

In any event, irrespective of the way the member 44 is attached to the file folder 20, the arms 36 and 38 of the member 44 are free to flex any where along their length to assist in removal and insertion of documents into the file folder 20.

Figure 3:
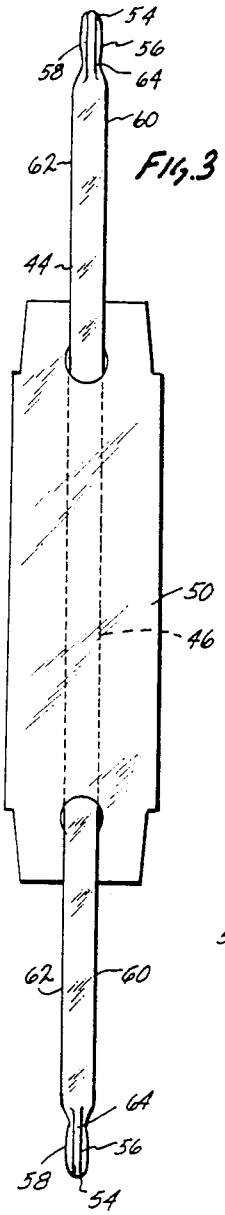
FIG. 3 is a top plan view of one of the components of the invention.
Figure 4:
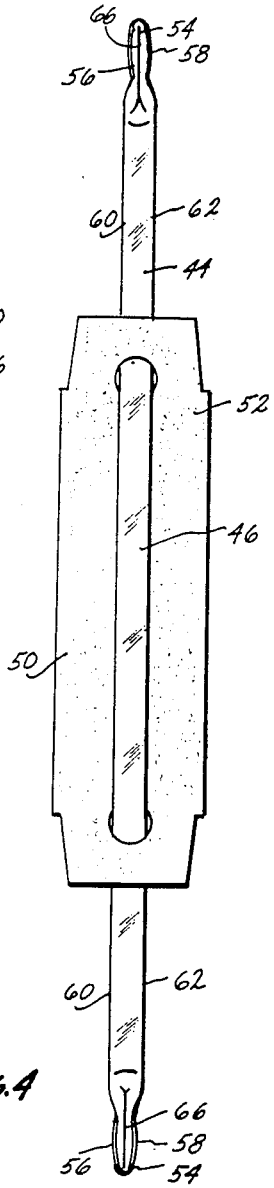
FIG. 4 is a bottom plan view of the component of FIG. 3.
Figure 5:
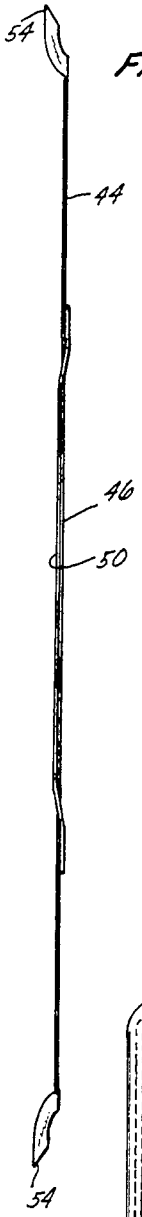
FIG. 5 is a side elevational view of the component of FIG. 3.
Figure 6:
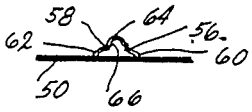
FIG. 6 is an end elevational view of the component of FIG. 3.

The ends, collectively identified by the numeral 54, of the member 44 are crimped or creased as is seen in the figures, such that as per the lower end 54 of the member 44 in FIGS. 3-5, the side edges 56 and 58 are folded toward one another. Because of this, side edge 56 and 58 lie parallel to one another but are spaced closer together than the side edges 60 and 62 along the remainder of the length of the arms 36 and 38 of the member 44. As formed, the protrusions 40 on the ends 54 of the arms 36 and 38 are the narrowest portion of the member 44.

The protrusions 40 have an arcuate crown 64 which is raised upwardly from the plane of the remainder of the arms 36 and 38 of the member 40. On the opposite side of the protrusion 40 is a channel 66 formed inbetween the two side edges 56 and 58. The elongated axis of the channel 66 lies along the elongated axis of the member 44. The protrusions 40 serve as structural ribs for the ends 54 of the member 44 such that it will not bend or deform along the protrusions, but will only bend or deform along the length of the arms 36 and 38 between the holes 48 and the beginning of the protrusions 40.

Figure 8:
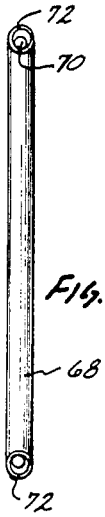
FIG. 8 is an end elevational view of the component of FIG. 7.
Figure 7:
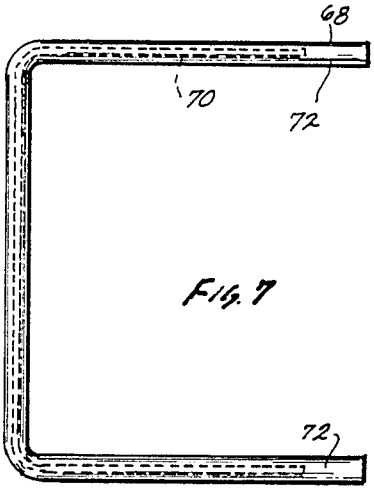
FIG. 7 is a plan view of a further component of the invention showing an interior member in phantom.

FIGS. 7 and 8 show details of the assisting element 42. In the preferred embodiment of the invention, it is formed as a two component structure having an outer hollow tubular member 68 and an internal support member 70. The tubular member 68 is preferably formed of a plastic tubing which is hollow. The support member 70 is formed of a resilient material, as for instance a stiff wire, which can be bent into essentially a U-shape and permanently retain its shape, as is shown in FIG. 7.

The support member 70 extends along the entire width of the assisting element 42, but only partly into the side arms. This leaves hollow spaces, collectively identified by the numeral 72, at the end of the side arms of the element 42. The tubular member 68 is chosen such that its interior diameter, i.e., the diameter of the hollow spaces 72, easily accepts and temporarily retains the protrusions 40 on the member 44. This allows for easy attachment of the assisting element 42 onto the protrusions 40 of the member 44. Further, since the outside diameter of the tubular member 68 is less than the width of the member 44 between the edges 60 and 62, it is very easy to slide documents up off of the member 44 onto the assisting element 42. The member 44, inbetween wherein the protrusions 40 attach to the arms 36 and 38, tapers from the width between the edges 56 and 58 to the width between the edges 60 and 62. Thus, when documents are pushed down off of the assisting element 42 back onto the fastener 30, they are assisted by the smooth taper shown at point 74 wherein the protrusions 40 connect to the remainder of the arms 36 and 38.

Preferably, the assisting element 42 is formed with essentially 90° angles. The distance between the arms of the assisting element 42 is the same as the distance between the holes 48 which, in turn, is the same distance as the holes 34 which are punched into the document 32. This allows for easy sliding of the documents onto the assisting element 42 and easy sliding back off the assisting element 42 onto the fastener 30.

Figure 9:
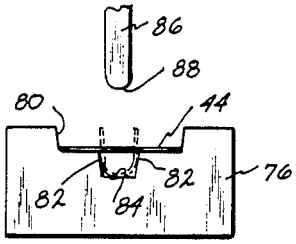
FIG. 9 is an elevational view of a first and second die utilized in conjunction with the elements of the previous figures.
Figure 10:
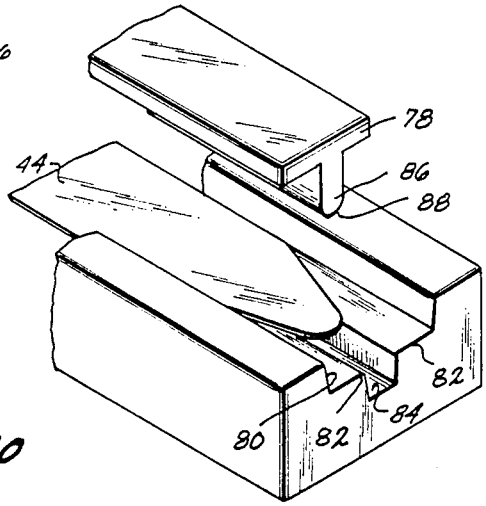
FIG. 10 is an isometric view of the components of FIG. 9.

In FIGS. 9 and 10, a method of forming the protrusions 40 on the ends of the arms 36 and 38 is shown. This utilizes a first die 76 and a second die 78. The die 76 has a first groove or depression 80 formed therein which is of a width just slightly greater than the width of the member 44 between the edges 60 and 62. Shoulders, collectively identified by the numeral 82, divide the groove 80 from a second groove 84. The groove 84 is significantly narrower than the width of the arms 36 and 38 between the edges 60 and 62.

The second die 78 includes a blade 86 which is rounded at its tip 88. The second die 78 only extends over the first die 76 the length of the protrusion 40. When an arm portion of the member 44 is located within the first die 76, and the second die 78 is brought down, the tip 88 of the blade 86 engages the top flat surface of the member 44 and depresses it downwardly into the groove 84 to bend the ends of the member 44 upwardly around the blade 86 as is shown in moving from the solid line in FIG. 9 to the phantom line in FIG. 9. This forms the protrusions 40 on the ends 54 of the member 44.

Shown in FIGS. 9 and 10 is a single die. However, during production of a file folder 20, a duel die can be utilized so as to crimp or form the protrusions 40 on both of the ends of the member 44 simultaneously. Alternately, a single die, as is seen in FIGS. 9 and 10, can be utilized to crimp the ends of existing fasteners in existing file folders so as to allow for conversion of an existing file folder to one which can be utilized in conjunction with the assisting member 42 of this invention.

As is evident in FIG. 3, the crown 64 of the protrusions 40 is preferably directed upwardly, such that when the fastener 30 is flat, holding documents within a file folder, the rounded edges of the crown are exposed. FIGS. 3, 4, and 5 are sized to approximately actual scale of the member 44 as utilized in a file folder. As is evident from FIG. 5, the height of the protrusion 40 is less than ⅛ inch and, as such, the inclusion of the protrusions 40 on the end of the member 44 does not add significant thickness to any file folder. The edges 56 and 58 of the protrusion 40 essentially lie parallel with the plane of the remainder of the member 44 allowing the protrusion 40 to lie very flat against the top documents within the file folder. This further contributes to the space saving qualities of this invention.

I claim:

1. An improvement in a document file folder which comprises:

a flat elongated member, said member having first and second ends and side edges, said member formed of a metallic material which is capable of repeatedly being deformed from an existing configuration to a new configuration and retaining said new configuration;

attaching means associated with said elongated member, said attaching means for fixedly attaching to said file folder a central portion of said elongated member wherein said central portion of said member is located intermediate the ends of said member;

said attaching means comprises an elongated flat attaching strip having first and second holes located adjacent to its ends along its elongated direction, said flat elongated member passing through said first and said second holes in said attaching strip with said central portion of said elongated member located on one side of said attaching strip and the remaining portion of said flat elongated member positioned on the other side of said flat attaching strip;

said flat attaching strip includes an adhesive material located on said side of said attaching strip wherein sid central portion of said elongated flat member is located;

each of said ends of said member crimped so as to bring the side edges of said flat member toward one another in a spaced parallel relationship and to form a protrusion portion on each of the ends of said member which extends beyond the plane of said flat member on one of the flat sides of said member, said protrusion portions being essentially U-shaped in cross section and having an elongated central channel, said elongated central channel having an axis which extends along the elongated dimensions of said channel with said axis of said channel lying along the elongated dimension of said member, the outside width of said member between its side edges along said protrusion portions being narrower than the width of said member between its side edges along the remainder of said member;

an element, said element having a first arm, a second arm and a connecting section which joins said first and said second arms, said first and said second element arms extending in a parallel space relationship from said connecting section in the same direction from said connecting section;

each of said first and said second arms of said element having a hollow open end, each of said hollow open ends of said element arms being sized and shaped to accept and temporarily retain one of said ends of said member.

2. The improvement of claim 1 wherein:

said element includes a flexible hollow tubular member having a rigid internal support member located within a portion of the hollow tubular member, the hollow tubular member divided into said first arm, said second arm, and said connecting section, said internal support member extending through the entirety of said connecting section and through a portion of each said first arm and said second arm so as to leave a hollow void adjacent to each of the ends of said tubular member to form said hollow open ends which accept said ends of said member and to fix said first and said second arms in said parallel relationship;

the internal diameter of said hollow tubular member at said hollow voids adjacent to said ends of said tubular member being greater than the width of said member between its side edges along said protrusion portions and less than the width of said member between it side edges along the remainder of said member whereby only said protrusion portions along said ends of said member are capable of being accepted in and retained in said hollow open ends of said element.

3. The improvement of claim 2 wherein:

said element is shaped as a U-shaped member having two essentially 90° bends at the junction point of said first and said second arms with said connecting section.

4. The improvement of claim 1 wherein:

said protrusion portions on each of said ends of said member are elongated protrusion portions having an arcuate crown which extends between said side edges of said member near said ends, said crown extending beyond the plane of said flat member on one of said flat sides of said member.

5. The improvement of claim 4 wherein:

a crown on the protrusion portion on one of said ends of said member is directed toward the crown on the protrusion portion on the other said ends of said member when said member is deformed so as to essentially locate the portion of said member on one side of said central portion and the portion of said member on the other side of said central portion in a space parallel relationship.

6. An improvement in a document file folder which comprises:

a flat elongated member, said member having first and second ends and side edges, said member formed of a metallic material which is capable of repeatedly being deformed from an existing configuration to a new configuration and retaining said new configuration;

attaching means associated with said elongated member, said attaching means for fixedly attaching to said file folder a central portion of said elongated member wherein said central portion of said member is located intermediate the ends of said member;

each of said ends of said member crimped so as to bring the side edges of said flat member toward one another in a spaced parallel relationship and to form a protrusion portion on each of the ends of said member which extends beyond the plane of said flat member on one of the flat sides of said member, said protrusion portions being essentially U-shaped in cross section and having an elongated central channel, said elongated central channel having an axis which extends along the elongated dimension of said channel with said axis of said channel lying along the elongated dimension of said member, the outside width of said member between its side edges along said protrusion portions being narrower than the width of said member between its side edges along the remainder of said member;

an element, said element having a first arm, a second arm and a connecting section which joins said first and said second arms, said first and said second element arms extending in a parallel space relationship from said connecting section in the same direction from said connecting section;

each of said first and said second arms of said element having a hollow open end, each of said hollow open ends of said element arms being sized and shaped to accept and temporarily retain one of said ends of said member;

said element includes a flexible hollow tubular member having a rigid internal support member located within a portion of the hollow tubular member, the hollow tubular member divided into said first arm, said second arm, and said connecting section, said internal support member extending through the entirety of said connecting section and through a portion of each said first arm and said second arm so as to leave a hollow void adjacent to each of the ends of said tubular member to form said hollow open ends which accept said ends of said member and to fix said first and said second arms in said parallel relationship;

the internal diameter of said hollow tubular member at said hollow voids adjacent to said ends of said tubular member being greater than the width of said member between its side edges along said protrusion portions and less than the width of said member between it side edges along the remainder of said member whereby only said protrusion portions along said ends of said member are capable of being accepted in and retained in said hollow open ends of said element;

said element being shaped as a U-shaped member having two essentially 90° bends at the junction point of said first and said second arms with said connecting section.

7. The improvement of claim 6, wherein:

said attaching means comprises an elongated flat attaching strip having first and second holes located adjacent to its ends along its elongated direction, said flat elongated member passing through said first and said second holes in said attaching strip with said central portion of said elongated member located on one side of said attaching strip and the remaining portion of said flat elongated member positioned on the other side of said flat attaching strip.

* * * * *